US005836383A

United States Patent [19]

Zwittig

[11] Patent Number: 5,836,383

[45] Date of Patent: Nov. 17, 1998

[54] HEAT TRANSFER DEVICE OF A PLATE SANDWICH STRUCTURE

[75] Inventor: Eberhard Zwittig, Hochdorf, Germany

[73] Assignee: Behr GmbH & Co., Stuttgart, Germany

[21] Appl. No.: 690,868

[22] Filed: Aug. 1, 1996

[30] Foreign Application Priority Data

Aug. 1, 1995 [DE] Germany ..... 195 28 116.0

[51] Int. Cl.[6] ..... F28D 9/00

[52] U.S. Cl. ..... 165/167; 165/DIG. 360; 165/DIG. 364

[58] Field of Search ..... 165/165, 166, 165/167

[56] References Cited

U.S. PATENT DOCUMENTS

| | | | |
|---|---|---|---|
| 2,428,880 | 10/1947 | Kintner | 165/167 |
| 2,623,736 | 12/1952 | Hytte | 165/167 X |
| 3,017,161 | 1/1962 | Slaasted . | |
| 4,744,414 | 5/1988 | Schon . | |
| 4,815,534 | 3/1989 | Fuerschbach . | |
| 5,193,611 | 3/1993 | Hesselgreaves | 165/165 |
| 5,212,004 | 5/1993 | Boettcher et al. . | |
| 5,409,058 | 4/1995 | Yuasa et al. | 165/167 |
| 5,429,183 | 7/1995 | Hisamori et al. . | |

FOREIGN PATENT DOCUMENTS

| | | |
|---|---|---|
| 929698 | 1/1948 | France . |
| 2412805 | 7/1979 | France . |
| 2 583 864 | 12/1986 | France . |
| 540918 | 2/1929 | Germany . |
| 37 09 278 | 3/1989 | Germany . |
| 32 06 397 | 10/1994 | Germany . |
| 629385 | 9/1949 | United Kingdom . |
| 1 252 142 | 11/1971 | United Kingdom . |
| 2 019 550 | 10/1979 | United Kingdom . |
| 2 162 630 | 2/1986 | United Kingdom . |

*Primary Examiner*—Allen J. Flanigan
*Attorney, Agent, or Firm*—Evenson, McKeown, Edwards & Lenahan, P.L.L.C.

[57] ABSTRACT

A heat transfer device with a plate sandwich structure includes at least two flow-duct-covering plates and one flow duct plate unit arranged in between which is formed of one or more superimposed flow duct plates each provided with flow duct breakthroughs. By means of the flow duct breakthroughs in one flow duct plate or by suitably overlapping flow duct breakthroughs of several adjoining flow duct plates, one or more flow paths are formed which extend predominantly in parallel to the plate plane between an inflow point and an outflow point. Such structures, capable of passing through one or more fluids passing through, are produced rather inexpensively and can be used, for example, as a battery cooling element.

15 Claims, 12 Drawing Sheets

HEAT TRANSFER DEVICE OF A PLATE SANDWICH STRUCTURE

BACKGROUND AND SUMMARY OF THE INVENTION

This invention relates to a heat transfer device of a sandwich-type structure constructed of several plates which are stacked upon one another, at least one of which is provided with flow-duct-forming breakthroughs.

Heat transfer devices of this type are described, for example, in German Patent document DE 32 06 397 C2. There, plates of the same type which are each provided with parallel rows of oblong breakthroughs are stacked upon one another such that the breakthroughs of one plate overlap with adjacent breakthroughs of the same row of an adjoining plate so as to be in a fluidal connection with one another. In this manner, each group of superimposed rows of breakthroughs forms a two-dimensional flow duct network. The network planes are situated in parallel to the stacking direction and the individual networks have no fluidal connection with respect to one another. By means of suitable inflow and outflow devices on the sides of the sandwich structure, in the direction of which the networks are open, the individual networks may be divided into several groups. A specific fluid flows through each of the groups.

From German Patent document DE 37 09 278 C2, a heat transfer device of a plate sandwich-type structure is known in which mutually stacked plates are provided on one of the flat sides with side-by-side longitudinal grooves which are used as flow ducts.

There is therefore needed a heat transfer device of the above-mentioned type whose plate sandwich structure can be produced with relatively low expenditures and which has a high resistance to pressure, a low internal volume, and a satisfactory heat transfer capacity.

These needs are met according to the present invention by a heat transfer device of a sandwich structure constructed of several plates which are stacked upon one another, at least one of which is provided with flow-duct-forming breakthroughs. The sandwich structure has at least two flow-duct-covering plates and one flow duct plate unit arranged in-between which is formed of one or more superimposed flow duct plates each provided with flow duct breakthroughs. By means of the flow duct breakthroughs in one flow duct plate or by mutually overlapping flow duct breakthroughs of several adjoining flow duct plates, one or more flow paths are formed which extend predominantly in parallel to the plate plane between an inflow point and an outflow point.

The construction of the plate sandwich structure can be carried out with relatively low expenditures in that the flow ducts for guiding through the heat transfer fluid or fluids are formed by appropriately arranged flow duct breakthroughs which may be formed in a simple manner, for example, by means of stamping. In the stacking direction, one or a plurality of flow duct plates combined to form a flow duct plate unit are covered on both sides by flow-duct-covering plates. This is done so that each flow path remains limited to the space between two flow-duct-covering plates, respectively, and therefore extends predominantly in parallel to the plate plane, in which case the flow duct plates are preferably designed such that a portion of an area which is as large as possible is perforated; that is, contributes to the flow paths. In comparison to the initially mentioned known, two-dimensional flow duct network, the forming of one-dimensional flow paths facilitates achieving a largely straight-line flow action. In addition, the heat transfer device can be implemented with a comparably small dimension in the stacking direction, that is, with a few plates. This is because the heat-exchange-causing flow paths extend within one or a few adjoining flow duct plates and not noticeably in the stacking direction.

In an advantageous embodiment of the invention, the plate sandwich structure for the heat transfer device contains only one flow duct plate as the flow plate unit into which one or more flow-path-forming flow duct breakthroughs are entered and which is situated between two pertaining flow-duct-covering plates. Thus, in a minimal construction, three individual plates are already sufficient for implementing an operable sandwich structure.

In a further development of the invention, each flow duct plate unit in the plate sandwich structure contains two plates provided with flow duct breakthroughs which overlap in a flow-path-forming manner. In this fashion, flow path arrangements may be implemented which, for topological or stability reasons, are not possible with breakthroughs in only one plate. In sections, the flow paths are divided into mutually overlapping breakthroughs in the two flow duct plates. The flow paths will then extend along their lengths alternately in one or the other plate and therefore still predominantly in parallel to the plates.

By means of a further embodiment of the invention, by way of one or both of the flow-duct-covering plates which bound a respective flow duct plate unit, an inflow and/or outflow to this flow duct plate unit is created. If the flow-duct covering plate is an end plate of the sandwich structure, this inflow and/or outflow opening may be used as a connection to the outside of the structure. The openings in the interior flow-duct-covering plates may be used, for example, for the parallel inflow and/or outflow of the fluid to and/or from several flow duct plate units which are each separated from one another by a flow-duct covering plate. It is understood that each inflow and/or outflow opening of a flow-duct-covering plate overlaps with a pertaining flow duct breakthrough of an adjoining flow duct plate. This overlapping area forms the inflow and/or outflow point of the flow duct plate.

In a further embodiment of the invention, by means of the overlapping of the corresponding inflow and/or outflow openings, inflow and/or outflow ducts extending in the stacking direction are formed by way of which one fluid, or several fluids, can be guided in parallel through the respective assigned flow duct plate units in the sandwich structure. In this case, the inflow and/or outflow openings in the flow duct plate units simultaneously form the respective inflow and/or outflow point of a pertaining flow path formed by one or more flow duct breakthroughs.

In a further embodiment of the invention, at least one interior flow-duct-covering plate is constructed as an unperforated separating plate. The separating plate forms a fluidal separation for two flow duct plate units which adjoin on both sides and through which therefore two different fluids can be guided. Heat can be transferred between the fluids by way of the separating plate.

In a further embodiment of the invention, the plate sandwich structure is produced in a particularly economical manner by the sandwich-folding of a continuous-loop metal sheet provided with the required breakthroughs and a subsequent fluid-tight connecting of the sandwich-folded and pressed-together sheet metal plate sections.

Other objects, advantages and novel features of the present invention will become apparent from the following detailed description of the invention when considered in conjunction with the accompanying drawings.

DETAILED DESCRIPTION OF THE DRAWINGS

Figure 1:
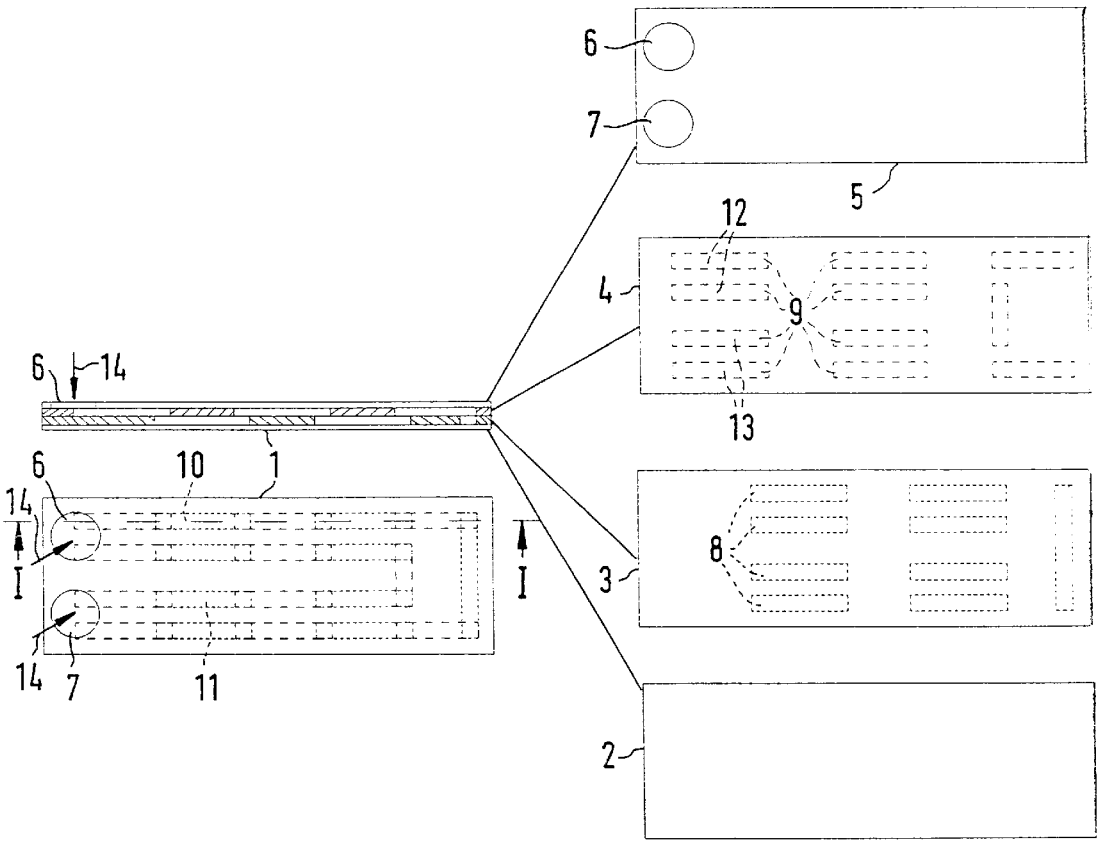
FIG. 1, in the left lower half, is a schematic top view of a sandwich structure of four plates for a single-fluid heat transfer device and, in the left upper half, is a longitudinal sectional view along Line I—I and, in the right half, contains top views of the four plates used in the structure.

Referring to the example of a single-fluid heat transfer device illustrated in FIG. 1, this heat transfer device contains a plate sandwich structure 1 of four rectangular plates 2 to 5 which are placed upon one another and which, in the right half of this figure, are illustrated in the stacking sequence from the bottom to the top in each case as individual top views. The lowest plate 2 is unperforated and forms the lower cover plate of the plate sandwich structure 1. The uppermost plate 5 forms the upper cover plate and is provided in a lateral area with two circular breakthroughs 6, 7. The breakthroughs 6, 7 are used as the inflow opening and the outflow opening for one fluid to be guided through the plate sandwich structure 1. The two flow duct plates 3, 4 situated between the cover plates 2, 5 are each provided with oblong flow duct breakthroughs 8, 9 in such a manner that the breakthroughs 8 of one flow duct plate 3 each overlap on the end side with pertaining breakthroughs of the other flow duct plate 4. As a result, the totality of these flow duct breakthroughs forms two parallel flow path 10, 11 which each extend between an inflow point 12 overlapping with the inflow opening 6 of the upper cover plate 5 and an outflow point 13 overlapping with the outflow opening 7 of the upper cover plate 5, as outlined by an interrupted line in the bottom left half of the figure.

In the projection onto the plane of the plate, both flow paths 10, 11 have a U-shaped design and together take up a noticeable fraction of the entire plate surface. When a fluid 14 is guided through this sandwich structure 1, it is guided in sections over a respective breakthrough in the upper 4 and lower flow duct plate 3 which together form a flow duct plate unit. In this case, the fluid changes in the overlapping areas from one breakthrough in one flow duct plate to a next breakthrough in the other flow duct plate, as illustrated in the left upper partial illustration of the figure. The two end-side cover plates 2, 5 hold the fluid 14 within the flow duct plate unit so that it flows along the length of the flow paths 10, 11 essentially in parallel to the plane of the plates, that is, perpendicularly to the stacking direction. The cover plates 2, 5 are used simultaneously as heat contact plates for providing a heat exchange between the fluid flowing in the flow duct plate unit and the area outside the two cover plates 2, 5.

All openings or breakthroughs 6, 7, 8, 9 in the used plates 2 to 5 can be produced in a simple manner by means of stamping. A deforming of the plates which requires higher technical expenditures for providing the flow ducts is eliminated. Furthermore, the figure illustrates that by means of the division of the two flow paths 10, 11 into appropriately mutually overlapping flow duct breakthroughs 8, 9 in the two flow duct plates 3, 4, a higher stability is maintained for the latter than if the two flow paths were to be formed directly in a single plate.

Figure 2:
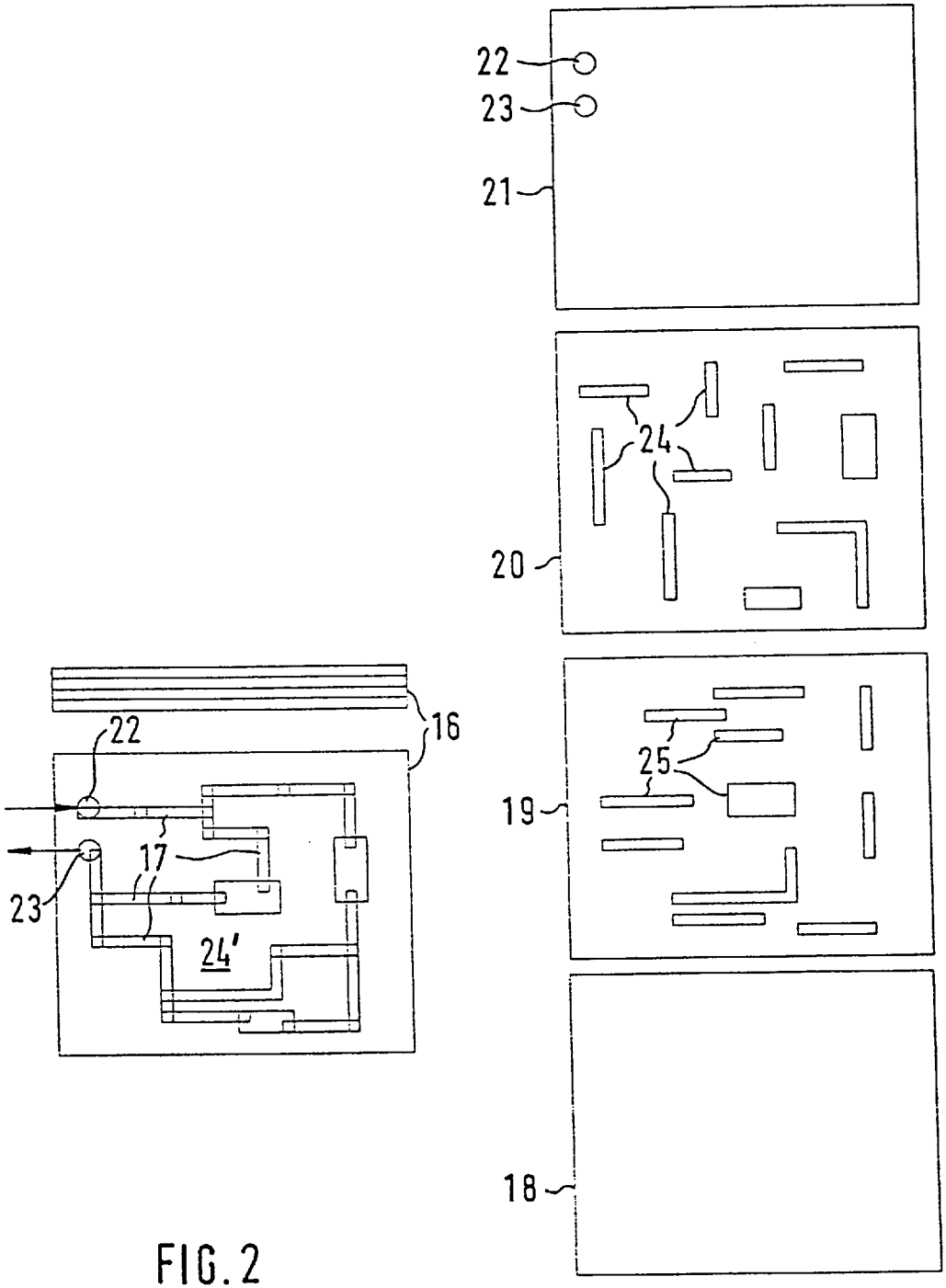
FIG. 2 is a representation analogous to FIG. 1 of another example of a single-fluid heat transfer device of a four plate sandwich structure, but having a four plate design which is modified with respect to FIG. 1 and with a lateral view as the left upper partial illustration.

FIG. 2 illustrates another example of a single-fluid heat transfer device of a sandwich structure 16 consisting of four plates 18 to 21. Like in the example of FIG. 1, the lower cover plate 18 is unperforated while the upper cover plate 21 again has two openings 22, 23 which are used as an inflow and/or an outflow and, for this purpose, in each case, overlap at one point with one of the flow duct breakthroughs 24 which are formed in the upper flow duct plate 20. Together with the flow duct breakthroughs 25 which are formed in the lower flow duct plate 19, when the two flow duct plates 19, 20 are placed on one another which together form the flow duct plate unit between the end-side cover plates 18, 21, the flow path network 17 is created which is illustrated in the left lower partial illustration. The flow path network 17 contains, originating from a flow path section leading away from the inflow point 22 and a flow path section leading to the outflow point 23, two branching and combining points respectively. Since, in this case, in the projection onto the plate plane, an area 24 ' exists which is completely surrounded by flow path sections, an implementation of this flow path network 17 would not be possible via a single flow duct plate. By contrast, the division of the flow path network 17 into the two flow duct plates 19, 20 results in two plates which can be provided with the required pattern of breakthroughs in a very simple manner by means of stamping.

Figure 3:
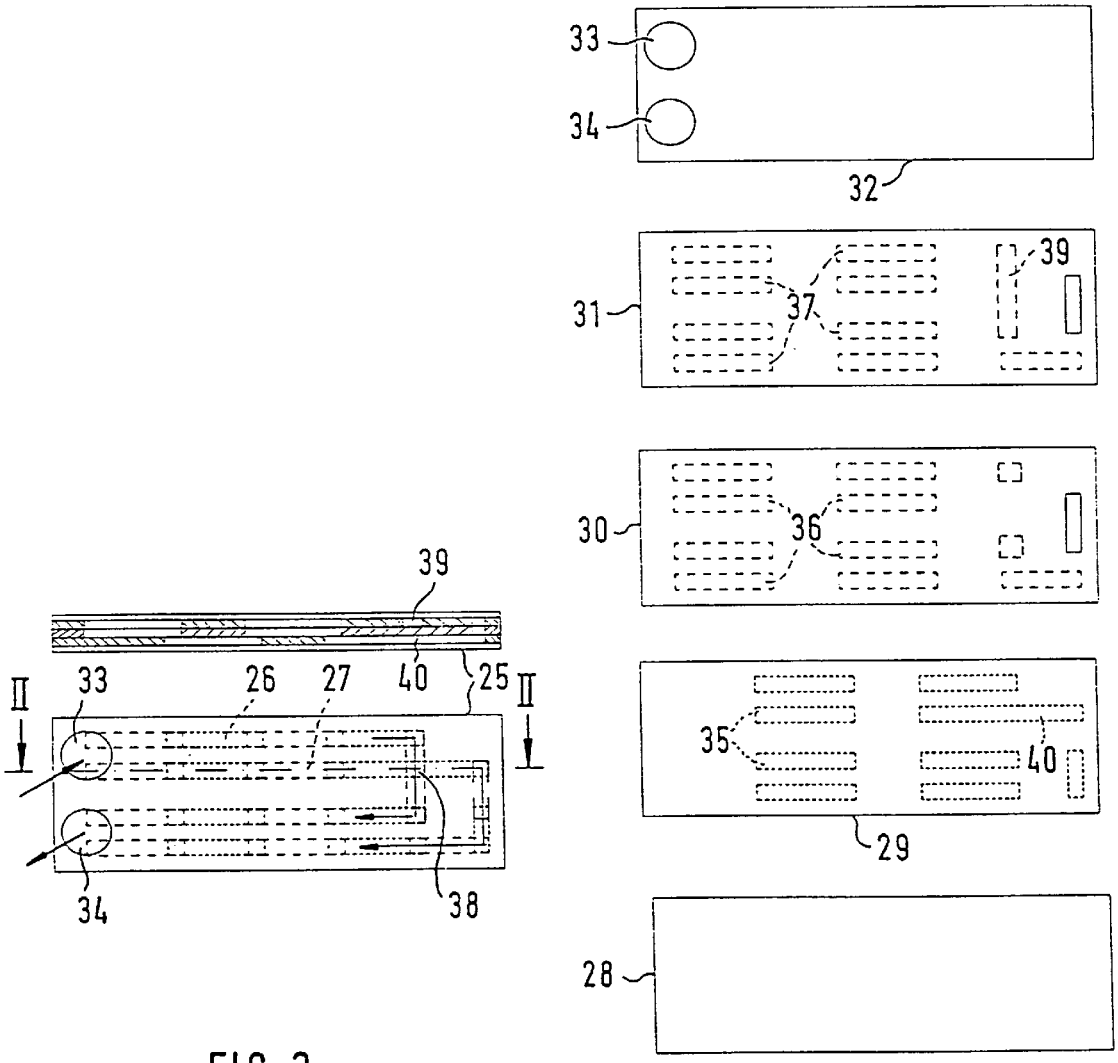
FIG. 3 is a representation analogous to FIG. 1 for a single-fluid heat transfer device of a sandwich structure having five plates, and with a sectional view taken along Line II—II as the left upper partial illustration.

FIG. 3 illustrates an example of a single-substance heat transfer device in which two flow paths 26, 27 which cross-one another and do not communicate with one another are formed within a plate sandwich structure 25 which consists of five plates 28 to 32 situated above one another. The lowest plate 28 again is formed by an unperforated cover plate while the uppermost plate is provided with an inflow opening 33 and an outflow opening 34. The flow duct plate unit situated between these two end-side plates 28, 32 contains three flow duct plates 29, 30, 31, which are each provided with appropriate flow duct breakthroughs 35, 36, 37 in such a manner that, because of their overlapping, when the three plates 29 to 31 are placed upon one another, the two paths 26, 27 are formed which are illustrated in the left lower partial illustration. These flow paths 26, 27 extend in the lateral projection again in a U-shaped manner between the inflow point of two breakthroughs 37 of the uppermost flow duct plate 31 overlapping with the inflow opening 33 and the outflow point of two additional flow duct breakthroughs 37 of this uppermost flow duct plate 31 which overlaps with the outflow opening 34. In this case, the two flow paths 26, 27 cross one another at a point 38 without any fluidal connection with one another. In this crossing area 38, one flow path 26 extends within a breakthrough 39 in the upper flow duct plate 31 while the other flow path 27 extends along a breakthrough 40 in the lower flow duct plate 29. In this crossing 38, the central flow duct plate 30 is unperforated and therefore provides the fluidal separation of the two flow paths 26, 27 in the cross-over area 38, as illustrated in the sectional view in the left lower partial illustration.

Figure 4:
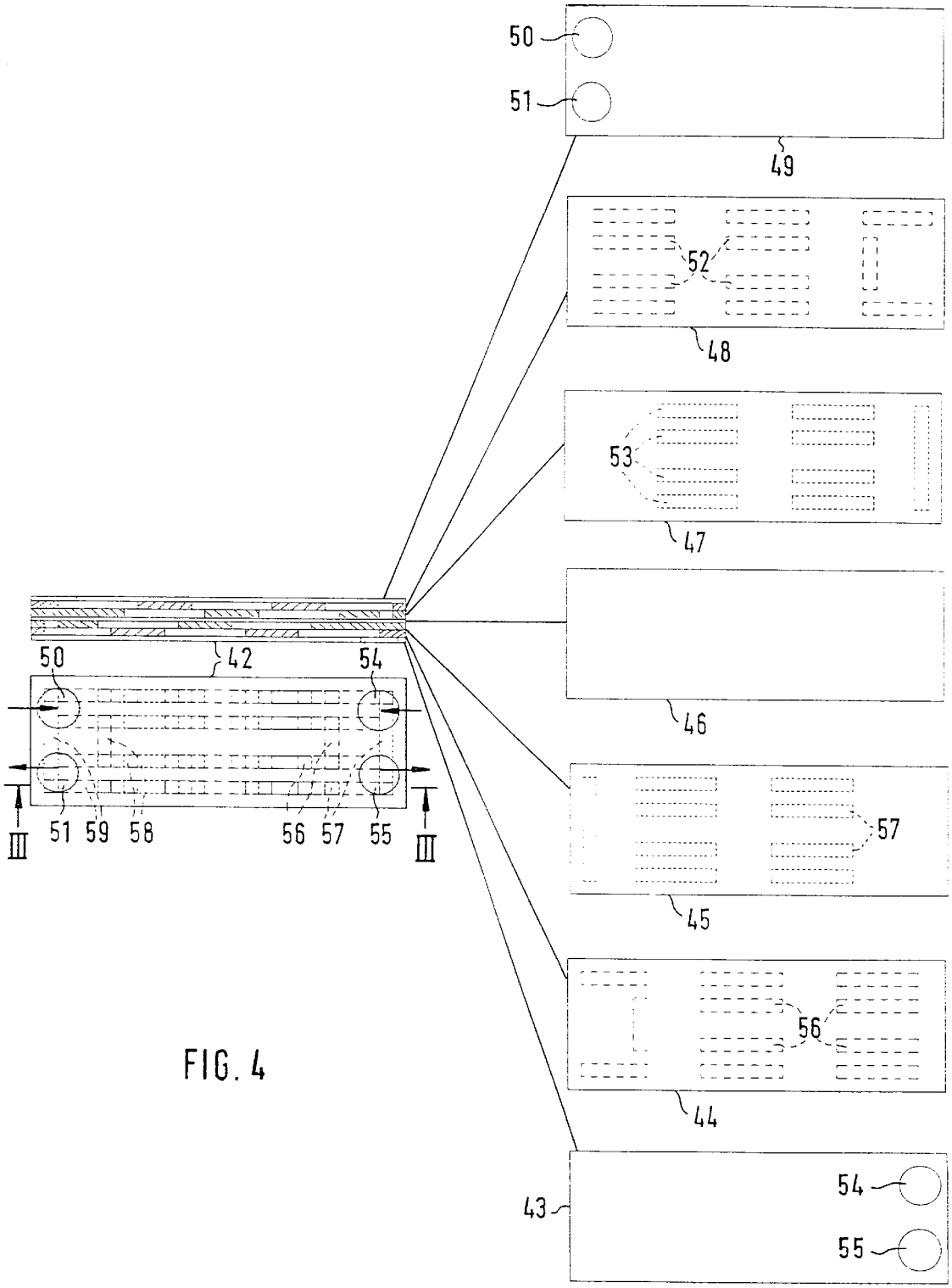
FIG. 4 is a representation analogous to FIG. 1 for a two-fluid heat transfer device with several flow duct plate units consisting of two flow duct plates respectively, and with a sectional view taken along Line III—III as the left upper partial illustration.

FIG. 4 illustrates a two-fluid heat transfer device of a plate sandwich structure 42 which is constructed of seven individual plates 43 to 49. The uppermost four plates 46 to 49, in their arrangement and design, correspond precisely to the four plates of the example of FIG. 1. By way of an inflow opening 50 and an outflow opening 51 in the uppermost cover plate 49, a first fluid can therefore be guided through the two parallel flow paths which are formed by the overlapping flow duct breakthroughs 52, 53 of the two interposed flow duct plates 47, 48 in the flow duct plate unit. The lowest 46 of the four upper plates 46 to 49, in this example, forms a separating plate which is adjoined on the bottom side by two flow duct plates 44, 45 and a closing lower cover plate 43. These three lower plates 43 to 45, as illustrated in the right half of the figure, each have a design identical to their counterparts in the upper sandwich half which are symmetrical with respect to the central separating plate 46, however, they are each rotated by 180° about the transverse axis of the plate with respect to their counterparts. Thus, the lowest flow-duct-covering plate 43, in the lateral area opposite to the uppermost cover plate 49, has an inflow opening 54 and an outflow opening 55 which overlap with corresponding inflow and outflow openings of breakthroughs 56 in the flow duct plate 44 situated on top. Their flow duct breakthroughs 56 overlap in turn with those breakthroughs 57 of the flow duct plate 45 situated on top for forming two additional parallel flow paths 58, 59 in the thus created lower flow duct plate unit. By means of the central, unperforated separating plate 46, the two fluids remain separated from one another while the heat can be transferred between the fluids over this separating plate 46.

Figure 5:
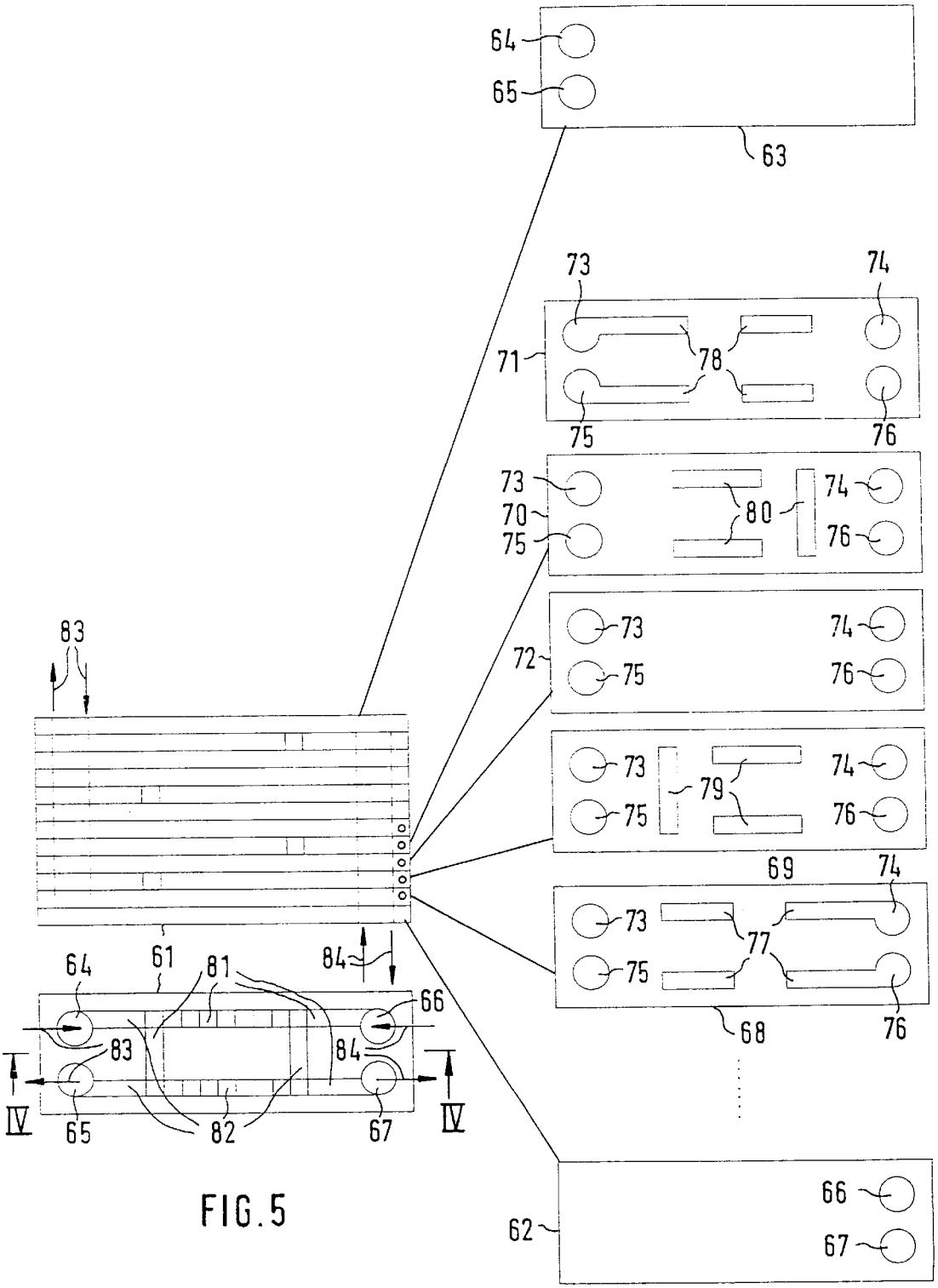
FIG. 5 is a representation analogous to FIG. 1 for a two-fluid heat transfer device of a sandwich structure having four plates, and with a sectional view taken along Line IV—IV as the left upper partial illustration.

FIG. 5 illustrates a two-fluid heat transfer device of a plate sandwich structure 61 in the case of which, for each of the two fluids, several flow duct plate units are provided such that respective different fluids flow through adjacent flow duct plate units. On the end side, a lower 62 and an upper cover plate 63 are provided, the upper cover plate 63 having an inflow and an outflow opening 64, 65 in a lateral area and the lower cover plate 62 having the same type of openings 66, 67 in an opposite lateral area. In-between, the plate stack consists of two or more flow duct plate units which each consist of two individual adjoining flow duct plates 68, 69; 70, 71 and are separated from one another in each case by a flow-duct covering plate 72. As shown in the right partial illustration, all of these interposed plates 68 to 71 in the two corresponding opposite lateral areas are provided with one distributor duct opening 73, 74 and one collecting duct opening 75, 76 respectively, which are aligned in the stacking direction and, as a result, together with the inflow openings 64, 66 or outflow openings 65, 67 of the outer plates 62, 63, in each case, form a distributor duct and collecting duct for the two heat transfer fluids which separately flow through the plate sandwich structure. In this case, one distributor and collecting duct opening 73, 75; 74, 76 respectively of one of the two flow duct plates 76, 71 of a flow duct plate unit is formed by the end of one of the flow duct breakthroughs 77, 78 so that they act as an inflow and outflow point for the concerned flow duct plate unit.

As further shown in the right partial illustration, the flow duct breakthroughs 77, 79; 78, 80 of the two plates 68, 69; 70, 71 of a flow duct plate unit overlap for forming a U-shaped flow path 81, 82. In this case, each plate 68, 69 of a flow duct plate unit is designed identically to its counterpart 71, 70 of an adjacent flow duct plate unit positioned symmetrically about the interposed flow-duct-covering plate 72 in the stack, but is arranged with respect to this counterpart to be rotated in each case by 180° about the transverse axis of the plate so that the flow path 81 of one flow duct plate unit is connected to a distributor duct and collecting duct and the flow path 82 of the adjacent flow duct plate unit is connected to the other distributor and collecting duct. Therefore, a different one of the two heat transfer fluids flows through adjacent flow duct plate units, in which case the heat between the two fluids can be transferred over the respective flow-duct-covering plate 72. Therefore, by arranging several pairs of such adjacent flow duct plate units with an interposed flow-duct-covering plate, a plate sandwich structure is implemented in the case of which, for two fluids 83, 84 supplied and removed on opposite stack sides, several parallel flow paths are created transversely to the stacking direction, in which case the flow paths for the one and for the other fluid alternate in order to achieve an optimal heat transfer action.

Figure 6:
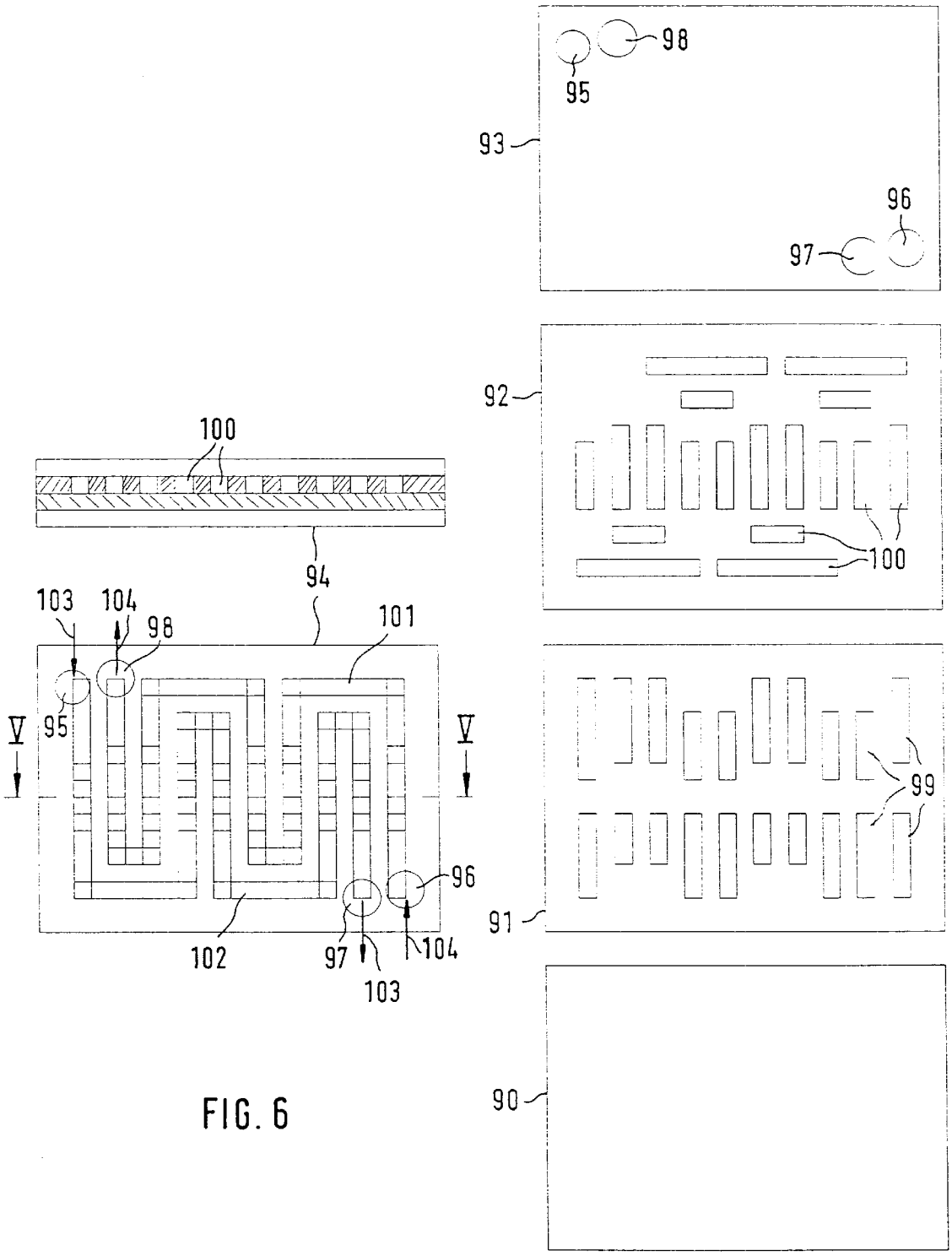
FIG. 6 is a representation analogous to FIG. 1, for a two-fluid heat transfer device of a sandwich structure having three plates, and with a sectional view taken along Line V—V as the left upper partial illustration.

FIG. 6 shows a two-fluid heat transfer device of a plate sandwich structure 94 which consists of four plates 90 to 93.

The inflow and outflow of both fluids take place from the same upper side of the sandwich structure. For this purpose, one inflow opening 95, 96 and one outflow opening 97, 98 respectively are entered in opposite corner areas in the upper, flow-duct-covering plate 93. The lower, flow-covering plate 90 is constructed as an unperforated cover plate. Between the two flow-duct-covering plates 90, 93, a flow duct plate unit is situated which consists of two flow duct plates 91, 92. The flow duct breakthroughs 99, 100 in these two flow duct plates 91, 92 are arranged such that they overlap to form two parallel extending, but mutually separate, meandering flow paths 101, 102. As illustrated in the left lower partial illustration, both flow paths 101, 102 extend between one inflow opening 95, 98 respectively in one corner area and one respective pertaining outflow opening 97, 98 in the opposite corner area. In this manner, two fluids 103, 104 can flow through them in the same direction, i.e., co-current, or preferably, as indicated by the arrows, in opposite directions, i.e., in countercurrent.

Figure 7:
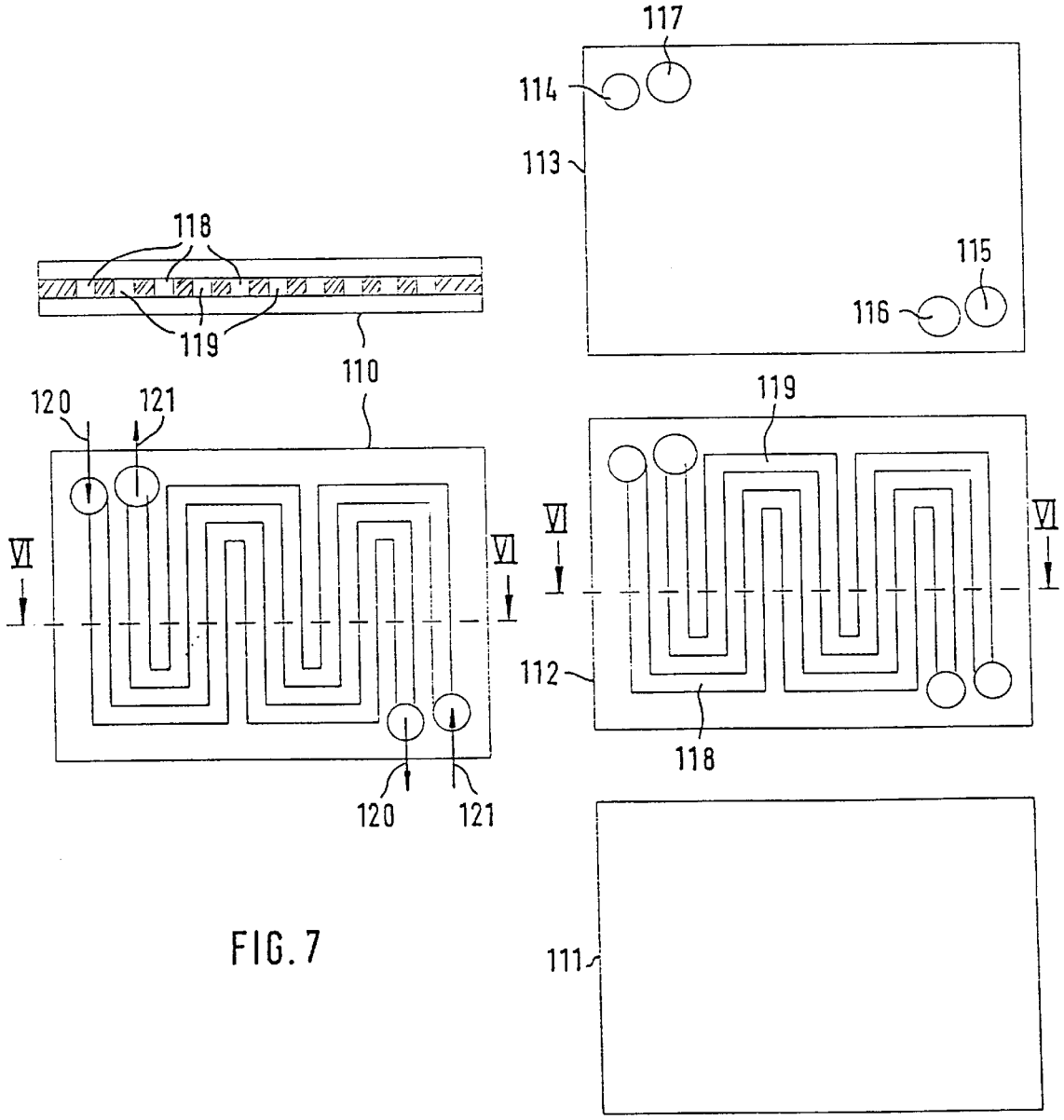
FIG. 7 is a representation analogous to FIG. 1, for a two-fluid heat transfer device having a minimal sandwich structure with three plates, and with a sectional view taken along Line VI—VI as the left upper partial illustration.

FIG. 7 shows a two-fluid heat transfer device which has a plate sandwich structure 110 constructionally requiring only three individual plates 111, 112, 113. The lowest flow-duct-covering plate 111 is designed as an unperforated plate, while one inflow opening 114, 115 and one outflow opening 116, 117 respectively are formed in the top flow-duct-covering plate 113 in opposite corner areas. The interposed flow duct plate 112 is provided with two meandering flow duct breakthroughs 118, 119 which are arranged to extend in parallel in sections, but separately from one another, and end in each case in opposite corner areas, in which they are provided with circularly expanded inflow and outflow points which are aligned with the inflow and outflow openings 114 to 117 of the upper flow-duct-covering plate 113. In this manner, two fluids 120, 121 can be guided in the co-current or, as indicated in the lower left partial illustration by the arrows, preferably in the countercurrent through the sandwich structure transversely to the stacking direction.

Figure 8:
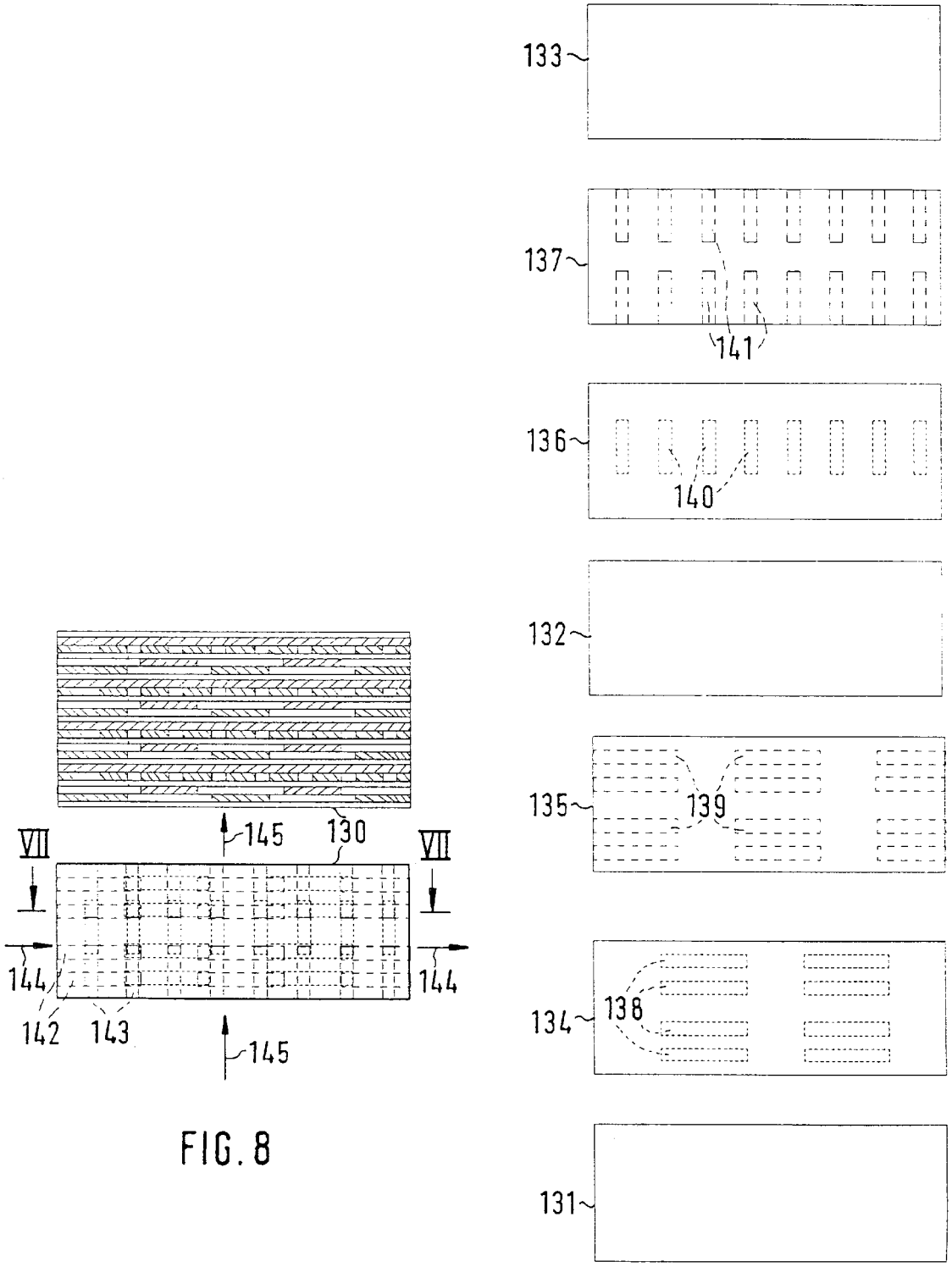
FIG. 8 is a representation analogous to FIG. 1, for a multifluid heat transfer device having several flow duct plate units of two flow duct plates respectively, and with a sectional view taken along Line VII—VII as the left upper partial illustration.

FIG. 8 shows a heat transfer device for two or more fluids. The inflow and the outflow of the fluids takes places laterally on the plate sandwich structure 130. For this reason, the sandwich structure 130 consists of a sequence of respective unperforated separating plates 131, 132, 133 between which one flow duct plate unit respectively is arranged which consists of two flow duct plates 134, 135; 136, 137. The flow duct breakthroughs 138, 139; 140, 141 of the two superimposed plates 134, 135; 135, 137 of a respective flow duct plate unit overlap in each case for forming several straight-line parallel flow paths 142, 143 as shown in the left lower partial illustration. The flow paths 142, 143 in this case, as a result of the corresponding design of the pertaining flow duct breakthroughs 139, 141 in each case of one 135, 137 of the two plates 134, 135; 136, 137 of a flow duct plate unit lead out in an open manner toward the corresponding lateral edges so that, from these sides of the sandwich structure, the inflow and the outflow of a respective heat transfer fluid flowing through the corresponding flow duct plate unit can occur. In the illustrated example, the flow duct breakthroughs 138, 139; 140, 141 of adjacent flow duct plate units are designed such that the pertaining flow paths 142, 143, in the projection onto the plate plane, extend perpendicularly with respect to one another. In this manner, two heat transfer fluids 144, 145, separated by an interposed separating plate 132, by way of which the heat transfer takes place between the fluids, can be guided in the cross-current through two adjacent flow duct plate units respectively. The inflow and the outflow of the fluids take place by way of the two pairs of opposite plate sides, in which case, on one respective plate side, only the flow duct breakthroughs of those flow duct plate units lead out in an open manner through which the fluid flows which flows in and out there, while the flow duct plates of the other flow duct plate units are closed on this lateral area. For example, an arrangement is advantageous in the case of which the same fluid flows through every other one of the flow duct plate units respectively.

Figure 9:
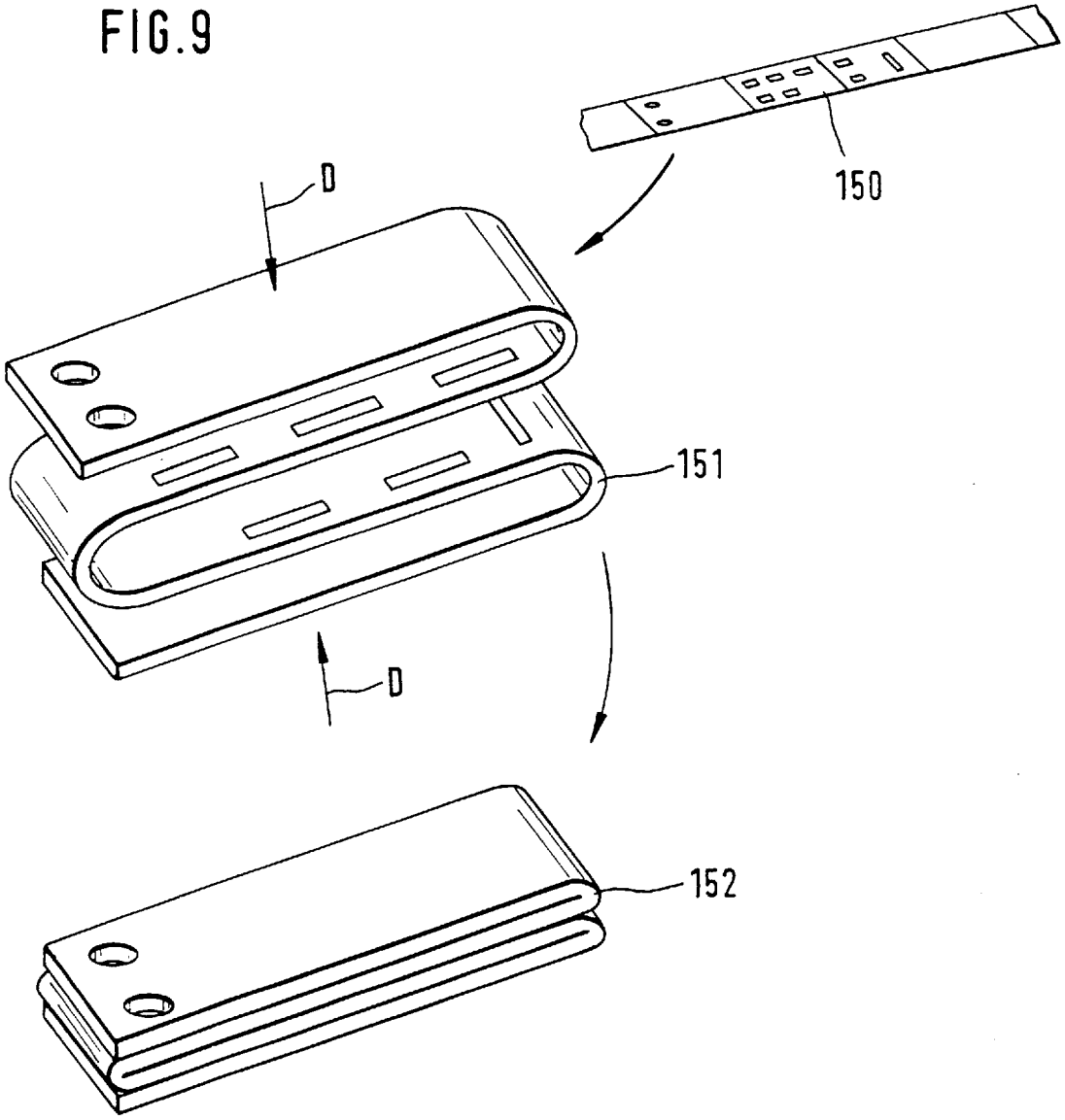
FIG. 9 is a schematic representation of the manufacturing of plate sandwich structures made from a continuous-loop sheet metal plate.

FIG. 9 shows a manufacturing process which is suitable for manufacturing the described and additional plate sandwich structures according to the invention as an alternative to the mutual stacking of individual plates of the same or of different plate thicknesses. In this process, in a first step, indicated in the figure in the top right, a continuous-loop metal sheet 150 is appropriately provided with the required breakthroughs by means of stamping. Subsequently, as illustrated in the center part of the figure, the perforated continuous-loop metal sheet 150 is folded such that the desired sheet metal plate sections come to rest above one another. The resulting sheet metal plate layering 151 is then pressed together to form the desired plate sandwich structure 152 by means of a pressure force (D), after which the adjoining sheet metal plate sections are connected in a fluid-tight manner. For example, depending on the material and requirements, soldering, gluing or welding can be used. By means of this process, the whole plate sandwich structure can be manufactured from a single starting component.

The above-mentioned connection techniques are suitable in the same manner for the fluid-tight connection of the plates during the manufacturing of the sandwich structure by means of placing individual plates above one another. In each case, the plate surfaces can be treated in a suitable manner, for example, by means of solder plating, adhesive coating, etc. Metals, plastic materials or ceramics may be used as the plate material. The end-side cover plates may, in each case, be appropriately coated, for example, enameled. In addition to being made by stamping, the opening or breakthroughs in the sheet metal plates may be formed by nibbling, laser cutting, or the like. Mutually overlapping flow duct breakthroughs of adjoining flow duct plates do not necessarily have to have a straight-line, collinear design but, as an alternative, may be designed as sloped, straight-line sections, as semicircular arches or as circular openings. This can be done so that, by means of their overlapping, flow paths are obtained which are zigzagged, undulated or continue by offset circular openings., For reducing weight, the plate may additionally be provided with blind openings which have no fluid flow function and are separated from the breakthroughs or openings with the fluid flow function.

Figure 10:
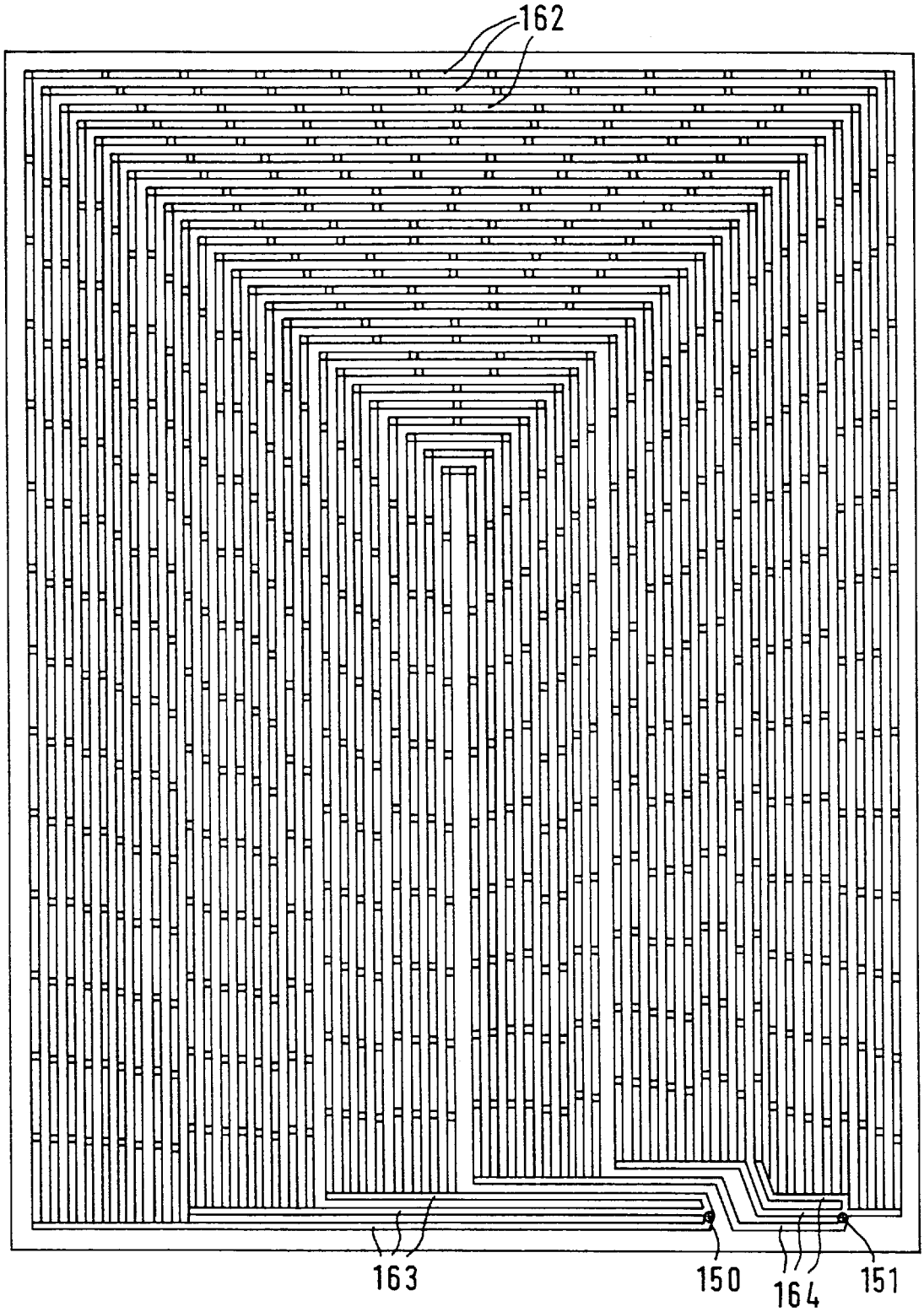
FIG. 10 is a schematic top view of a single-fluid heat transfer device used as a battery cooling element with a flow duct plate unit consisting of two flow duct plates.
Figure 11:
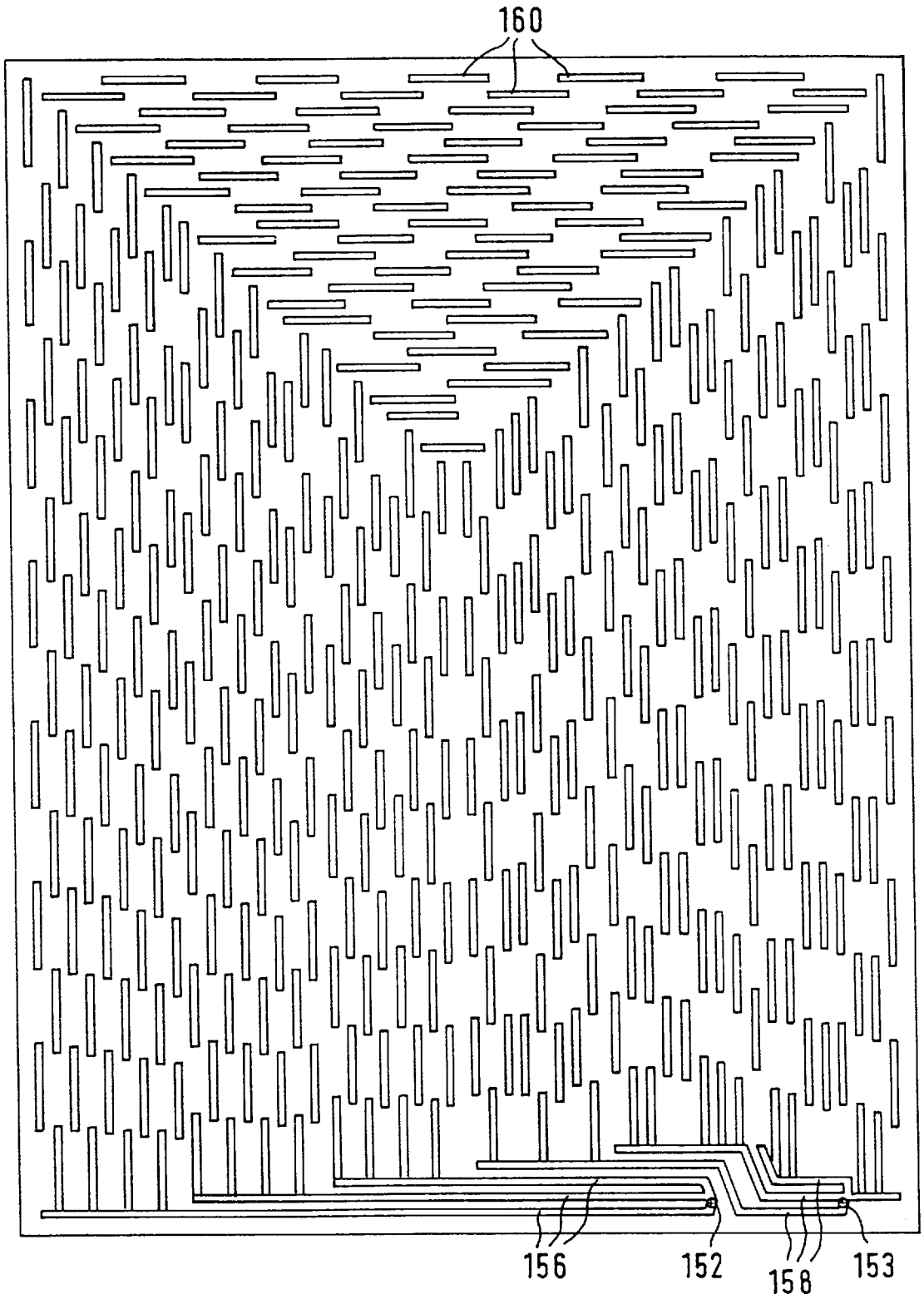
FIG. 11 is a top view of the first of the two flow duct plates of the battery cooling element of FIG. 10.
Figure 12:
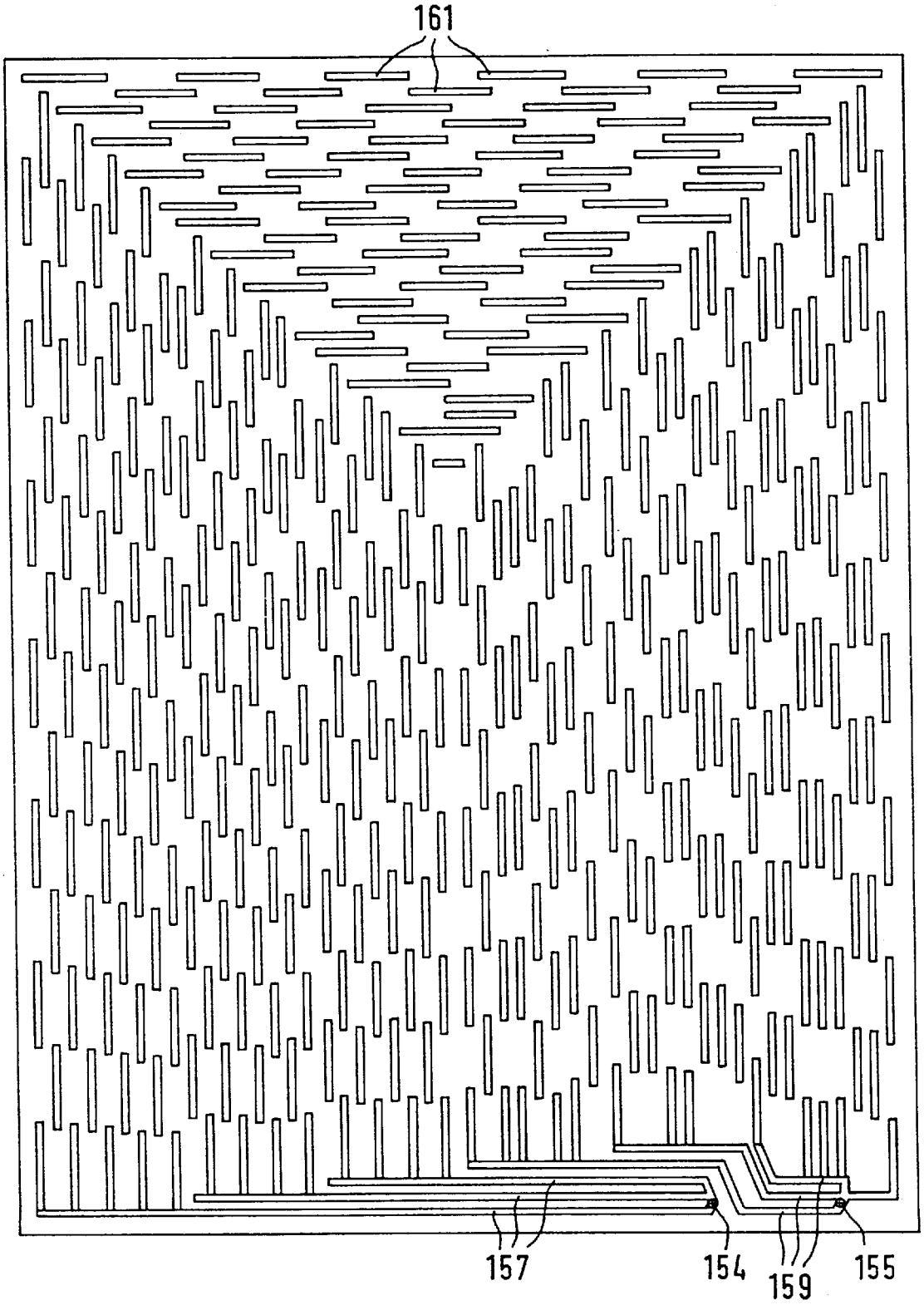
FIG. 12 is a top view of the second flow duct plate for the battery cooling element of FIG. 10.

FIG. 10 is a top view of a single-fluid heat transfer device in the form of a battery cooling element having a sandwich structure which consists of four plates and which is constructed in the manner of the example of FIG. 1. In particular, a lower unperforated cover plate and an upper cover plate provided with an inflow opening 150 and an outflow opening 151 are provided, between which a flow duct plate unit is situated which consists of two plates. The two pertaining flow duct plates are illustrated in FIG. 11 and FIG. 12. Both contain an inflow point 152, 154 which corresponds with the inflow opening 150 of the upper cover plate as well as an outflow point 153, 155 which corresponds with the outflow opening 151 of the upper cover plate. Three distributor lines 156, 157 respectively extend from the inflow and outflow points 152 to 155, and three corresponding collecting lines 158, 159 respectively lead into the respective outflow point 153, 155. Over the whole rectangular surface of the respective flow duct plate, pertaining, mutually separate, oblong flow duct breakthroughs 160, 161 are formed in such a manner that, when the two flow duct plates are placed on one another, these breakthroughs overlap forming a series of U-shaped flow paths 162 situated inside one another which, by means of their open ends, lead into one of the distributor and collecting lines 163, 164, respectively, of the flow duct plate unit formed by the aligned overlapping of the two individual distributor and collecting lines 156, 157; 158, 159, as illustrated in FIG. 10. By means of this structure, a battery can be effectively cooled by the guiding of a cooling fluid through the plate sandwich structure, the heat transfer device, in this case, being used as a heat sink.

Additional applications of the heat transfer device according to the invention having a plate sandwich structure are for cooling surfaces for other purposes, for example, for the cooling of electronic components as well as heating surfaces, for example, floors. In this case, the heat changes essentially by way of heat conduction or heat radiation into or from the heat transfer device or between various heat transfer fluids guided therethrough.

Although the invention has been described and illustrated. in detail, it is to be clearly understood that the same is by way of illustration and example, and is not to be taken by way of limitation. The spirit and scope of the present invention are to be limited only by the terms of the appended claims.

What is claimed is:

1. A heat transfer device, comprising:

a sandwich structure constructed of several plates and/or plate sections arranged one above another, at least one of which is provided with flow-duct-forming breakthroughs, the sandwich structure comprising:

at least two flow-duct-covering plates and/or plate sections and one flow duct plate unit arranged in-between which is formed of one or more superimposed flow duct plates and/or plate sections each provided with flow duct breakthroughs, wherein one or more distinct, separate flow paths, each of which extend continuously between an inflow point and an outflow point, are formed by the flow duct breakthroughs in one flow duct plate and/or plate section or by mutually overlapping flow duct breakthroughs of several adjoining flow duct plates and/or plate sections, said flow paths extending predominantly in parallel to the plate plane between the inflow point and the outflow point.

2. The heat transfer device according to claim 1, wherein the flow duct plate unit comprises a single flow duct plate into which one or more flow duct breakthroughs are formed which each extend in a continuous manner between the inflow point and the outflow point, for forming one or more corresponding flow paths.

3. The heat transfer device according to claim 1, wherein the flow duct plate unit comprises two flow duct plates provided with flow duct breakthroughs, said breakthroughs of the two plates overlapping for forming one or more flow paths.

4. The heat transfer device according to claim 1, wherein at least one of the two flow-duct-covering plates has at least one of an inflow opening and an outflow opening.

5. The heat transfer device according to claim 2, wherein at least one of the two flow-duct-covering plates has at least one of an inflow opening and an outflow opening.

6. The heat transfer device according to claim 3, wherein at least one of the two flow-duct-covering plates has at least one of an inflow opening and an outflow opening.

7. The heat transfer device according to claim 4, wherein all interior plates of the plate sandwich structure have one or more, mutually separated, inflow openings and outflow openings which each overlap in a stacking direction and which overlap with respective inflow and outflow openings which are formed in one flow duct covering plate or in a distributed manner in both stack-end-side flow-duct covering plates.

8. The heat transfer device according to claim 5, wherein all interior plates of the plate sandwich structure have one or more, mutually separated, inflow openings and outflow openings which each overlap in a stacking direction and which overlap with respective inflow and outflow openings which are formed in one flow duct covering plate or in a distributed manner in both stack-end-side flow-duct covering plates.

9. The heat transfer device according to claim 6, wherein all interior plates of the plate sandwich structure have one or more, mutually separated, inflow openings and outflow openings which each overlap in a stacking direction and which overlap with respective inflow and outflow openings which are formed in one flow duct covering plate or in a distributed manner in both stack-end-side flow-duct covering plates.

10. The heat transfer device according to claim 1, wherein at least one interior flow-duct-covering plate is provided in the form of an unperforated separating plate.

11. The heat transfer device according to claim 2, wherein at least one interior flow-duct-covering plate is provided in the form of an unperforated separating plate.

12. The heat transfer device according to claim 3, wherein at least one interior flow-duct-covering plate is provided in the form of an unperforated separating plate.

13. The heat transfer device according to claim 4, wherein at least one interior flow-duct-covering plate is provided in the form of an unperforated separating plate.

14. The heat transfer device according to claim 7, wherein at least one interior flow-duct-covering plate is provided in the form of an unperforated separating plate.

15. The heat transfer device according to claim 1, wherein the plate sandwich structure is produced by a sandwich-folding of a continuous-loop metal sheet provided with the required flow duct breakthroughs and a subsequent fluid-tight connecting of the sheet metal plate sections folded upon one another and pressed together.

* * * * *